US010000884B2

(12) United States Patent
Bang et al.

(10) Patent No.: US 10,000,884 B2
(45) Date of Patent: Jun. 19, 2018

(54) WASHING MACHINE

(71) Applicant: SAMSUNG ELECTRONICS CO., LTD., Suwon-si (KR)

(72) Inventors: Eun-Suk Bang, Hwaseong-si (KR); Hyun Sook Kim, Hwaseong-si (KR); Yun Joo Chang, Suwon-si (KR); Bo-Ram Lee, Yongin-si (KR); Ji-Yu Lee, Incheon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 464 days.

(21) Appl. No.: 14/590,197

(22) Filed: Jan. 6, 2015

(65) Prior Publication Data

US 2016/0153134 A1 Jun. 2, 2016

(30) Foreign Application Priority Data

Dec. 1, 2014 (KR) ..... 10-2014-0169783

(51) Int. Cl.
*D06F 39/08* (2006.01)
*D06F 35/00* (2006.01)

(52) U.S. Cl.
CPC ..... *D06F 39/083* (2013.01); *D06F 35/002* (2013.01); *D06F 39/085* (2013.01)

(58) Field of Classification Search
CPC ..... D06F 35/002; D06F 39/083; D06F 39/085
See application file for complete search history.

(56) References Cited

U.S. PATENT DOCUMENTS 5,829,459 A * 11/1998 Milocco ..... A47L 15/4291 134/201
2008/0250823 A1* 10/2008 Oak ..... D06F 35/002 68/5 C
2010/0236000 A1* 9/2010 Kim ..... D06F 35/002 8/159
2010/0263410 A1 10/2010 Oak et al.
(Continued)

FOREIGN PATENT DOCUMENTS

CN 101265254 A 10/2008
CN 102644183 A 8/2012
EP 3 184 687 A1 6/2017
(Continued)

OTHER PUBLICATIONS

European Search Report dated Feb. 27, 2015 in corresponding European Patent Application No. 15150173.1.
(Continued)

*Primary Examiner* — Joseph L. Perrin
(74) *Attorney, Agent, or Firm* — Staas & Halsey

(57) ABSTRACT

Disclosed herein is a washing machine capable of realizing a circulation function and a bubble function at the same time. The washing machine includes a main body, a tub provided in the main body, a pump provided to circulate wash water into the tub, and a circulation bubble unit provided on a flowing route of the wash water flowing out from the pump, wherein the circulation bubble unit is provided to be connected with the tub, and includes a first fluid path provided so that some of the wash water flowing out from the pump is circulated into the tub, and a second fluid path provided to generate bubbles in the wash water using another some of the wash water.

12 Claims, 15 Drawing Sheets

(56) References Cited

U.S. PATENT DOCUMENTS

| | | | |
|---|---|---|---|
| 2012/0096652 | A1 | 4/2012 | Choi et al. |
| 2012/0204607 | A1 | 8/2012 | Yang et al. |

FOREIGN PATENT DOCUMENTS

| | | |
|---|---|---|
| JP | 2005-7224 | 1/2005 |
| KR | 10-2012-0040793 | 4/2012 |

OTHER PUBLICATIONS

European Office Action dated Feb. 15, 2017 from European Patent Application No. 15150173.1, 5 pages.
European Examination Report dated Jan. 10, 2018 in corresponding European Patent Application No. 15 150 173.1, 5 pgs.
Chinese Office Action dated Dec. 4, 2017 in corresponding Chinese Patent Application No. 201510005307.5, 22 pgs.
Chinese Office Action dated Apr. 4, 2018, in corresponding Chinese Patent Application No. 201510005307.5.

* cited by examiner

WASHING MACHINE

CROSS-REFERENCE TO RELATED APPLICATION

This application claims the benefit of Korean Patent Application No. 10-2014-0169783, filed on Dec. 1, 2014 in the Korean Intellectual Property Office, the disclosure of which is incorporated herein by reference.

BACKGROUND

1. Field

Embodiments of the present invention relate to a washing machine which is capable of realizing a circulation function and a bubble function at the same time.

2. Description of the Related Art

In general, a washing machine (typically, a drum washing machine) includes a water tank which stores water (wash water or rinse water), a drum which is rotatably installed in the water tank to accommodate laundry, and a driving motor which generate a driving force used to rotate the drum.

The washing machine is an apparatus in which a washing operation is performed by moving the laundry up in the drum along an inner wall of the drum and then dropping the laundry, while the cylindrical drum is rotated.

The washing machine performs a series of operations such as a washing stroke which separates contaminants from the laundry using water (wash water) in which a detergent is dissolved, a rinsing stroke which rinses remaining detergent or bubbles from the laundry using water (rinse water) in which the detergent is not contained, and a dewatering stroke which dewaters the laundry at a high speed. The washing is performed by putting the detergent into the water tank together with the water, transferring the water and the detergent to the laundry, and then dropping the laundry.

Recently, to enhance washing power, a washing machine having a bubble generating unit configured to generate bubbles is popularized.

Meanwhile, such a washing machine having a bubble generating unit has a circulating pump which may effectively transfer detergent water to the laundry, and selectively use a circulation function and a bubble function using one circulating pump.

SUMMARY

Therefore, it is an aspect of the present invention to provide a washing machine which is capable of realizing a circulation function and a bubble function at the same time.

Also, it is another aspect of the present invention to provide a washing machine which is capable of realizing the circulation function and the bubble function at the same time, and thus more effectively transferring detergent water to the laundry using the bubble and the circulation function.

Also, it is still another aspect of the present invention to provide a washing machine which is capable of uniformly infiltrate wash water into the entire laundry by the circulation function and enhancing washing performance without damage of surfaces and fibers of the laundry through the bubble function.

Additional aspects of the invention will be set forth in part in the description which follows and, in part, will be obvious from the description, or may be learned by practice of the invention.

In accordance with one aspect of the present invention, a washing machine includes a main body, a tub provided in the main body, a pump provided to circulate wash water into the tub, and a circulation bubble unit provided on a flowing route of the wash water flowing out from the pump, wherein the circulation bubble unit is provided to be connected with the tub, and includes a first fluid path provided so that some of the wash water flowing out from the pump is circulated into the tub, and a second fluid path provided to generate bubbles in the wash water using another some of the wash water.

The circulation bubble unit may include an air introducing part provided so that air is introduced into the second fluid path.

The circulation bubble unit may include a case configured to form an exterior and having a fluid path formed therein, a first fluid path pipe formed to be branched from the fluid path of the case, a second fluid path pipe provided to be in communication with the fluid path and the tub, and a fixing unit provided at the case to be fixed with the tub.

The fluid path, the first fluid path pipe and the second fluid path pipe may be formed to have different diameters from each other.

The first fluid path may include a circulation hose configured to connect the first fluid path pipe with the tub.

The second fluid path pipe may be formed to be inclined upward toward a bottom surface of the tub.

The second fluid path may include a reduced diameter portion formed to have a diameter which is smaller than that of the first fluid path, and an increased diameter portion formed to be inclined toward the bottom surface of the tub so as to have a greater diameter than the reduced diameter portion.

The fixing unit may be provided to protrude from an outer circumferential surface of one end of the case and to be coupled to the bottom surface of the tub.

The washing machine may further include a connecting hose provided to connect the case and the pump.

The pump may include an introduction chamber into which the wash water in the tub is introduced, a circulation pump chamber provided to supply the wash water into the tub, and a drainage pump chamber provided to discharge the wash water to an outside of the main body, and the circulation bubble unit may be connected to the circulation pump chamber.

The air introducing part may be disposed at an outer circumferential surface of the case to be in communication with the second fluid path.

The air introducing part may be provided to connect the case and the tub.

The air introducing part may further include an electromagnetic control valve.

The air introducing part may be disposed at the circulation pump chamber.

In accordance with another aspect of the present invention, a washing machine include a main body, a tub disposed in the main body, a pump provided under the tub, and a circulation bubble unit provided to circulate wash water to the pump and simultaneously to generate bubbles in detergent water in which the wash water and a detergent are mixed.

The circulation bubble unit may be connected with the tub, and may include a first fluid path provided so that some of the wash water flowing out from the pump is circulated into the tub through a circulation hose, and a second fluid path provided to generate bubbles in detergent water in which the wash water and the detergent are mixed using another some of the wash water flowing out from the pump and then to supply the bubbles to the tub.

The circulation bubble unit may include an air introducing part provided so that air is introduced into the second fluid path.

The circulation bubble unit may include a case having a fluid path formed therein, a first fluid path pipe formed at one side of the case to be branched from the fluid path, a second fluid path pipe provided at one end of the case to be in communication with the fluid path and the tub, and a fixing unit provided at the case to be fixed with the tub.

The first fluid path may include a circulation hose provided to connect the first fluid path pipe with the tub.

The second fluid path pipe may be formed to be inclined upward toward a bottom surface of the tub.

The second fluid path may include a reduced diameter portion formed to have a diameter which is smaller than that of the first fluid path, and an increased diameter portion formed to be inclined toward the bottom surface of the tub so as to have a greater diameter than the reduced diameter portion.

The pump may include an introduction chamber into which the wash water in the tub is introduced, a circulation pump chamber provided to supply the wash water into the tub, and a drainage pump chamber provided to discharge the wash water to an outside of the main body, and the circulation bubble unit may be connected to the circulation pump chamber.

The air introducing part may be disposed at an outer circumferential surface of the case to be in communication with the second fluid path.

The air introducing part may be provided to connect the case and the tub.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Hereinafter, embodiments of the present invention will be described in detail with reference to the accompanying drawings.

Meanwhile, the terms "upper end", "rear end", "upper portion", "lower portion", "upper end" and "lower end" used in the following description are defined based on the drawings, and shapes and positions of construction elements are not limited by the terms.

Figure 1:
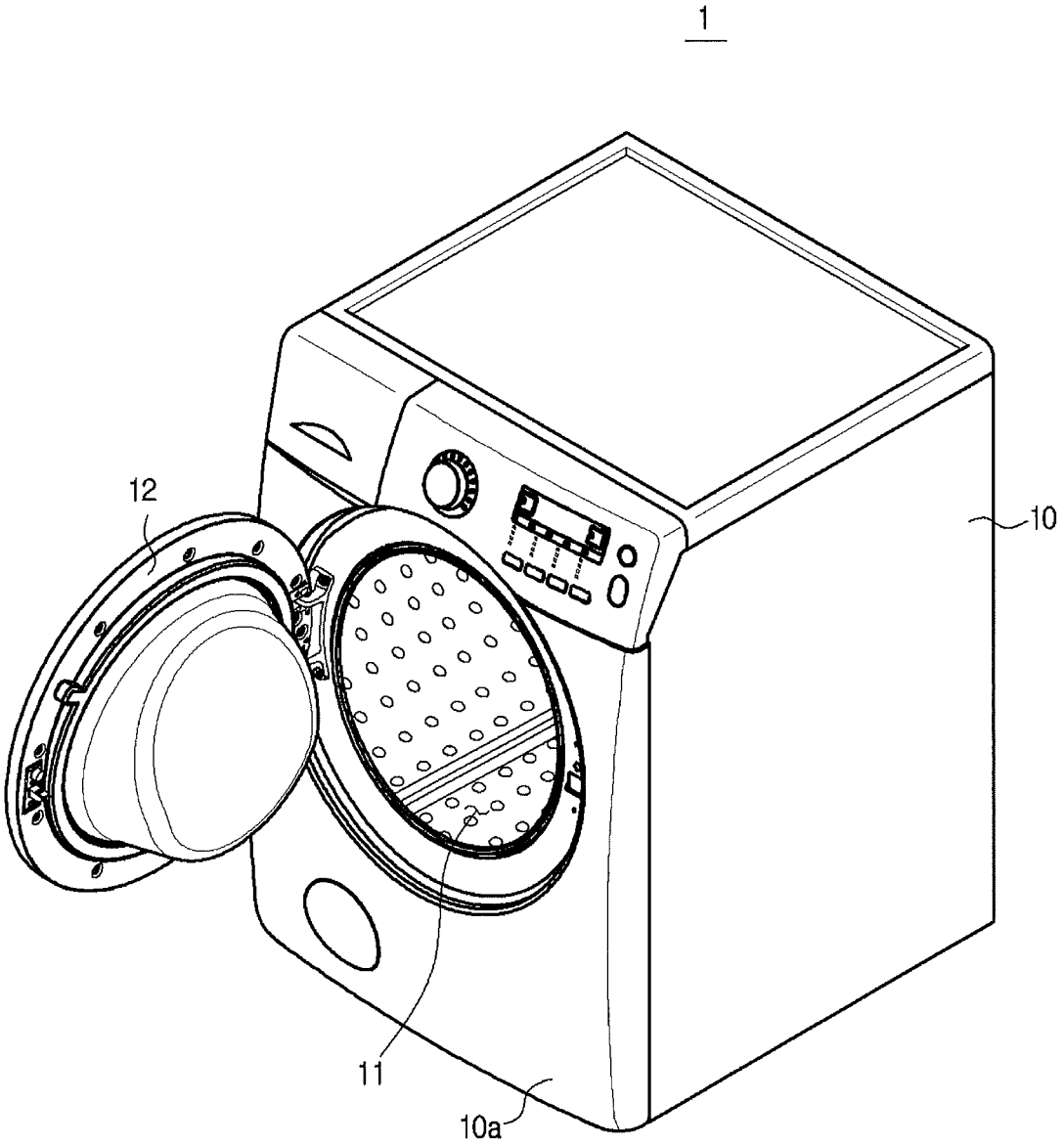
FIG. 1 is a perspective view of a drum washing machine according to one embodiment of the present invention.
Figure 2:
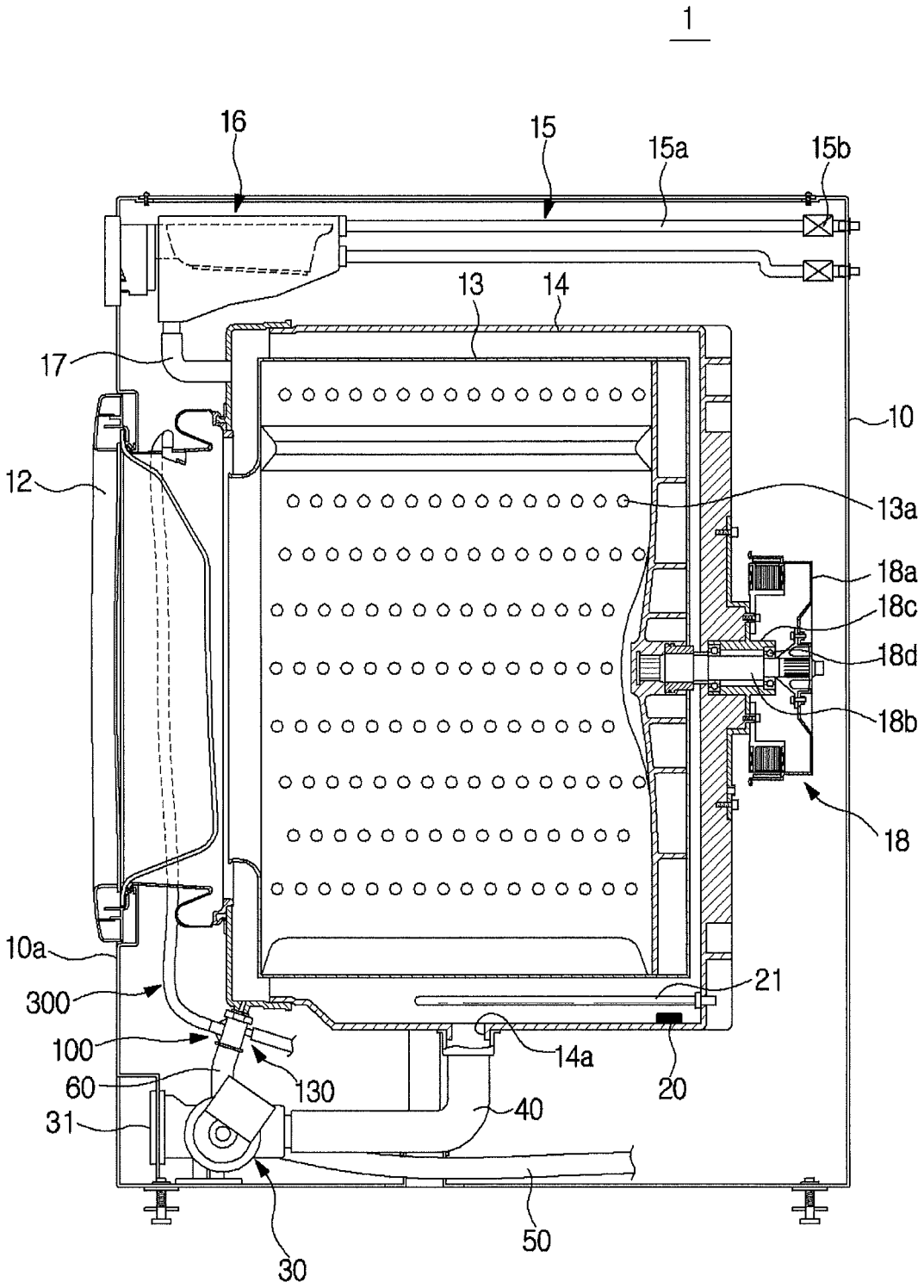
FIG. 2 is a cross-sectional view of the drum washing machine according to one embodiment of the present invention.
Figure 3:
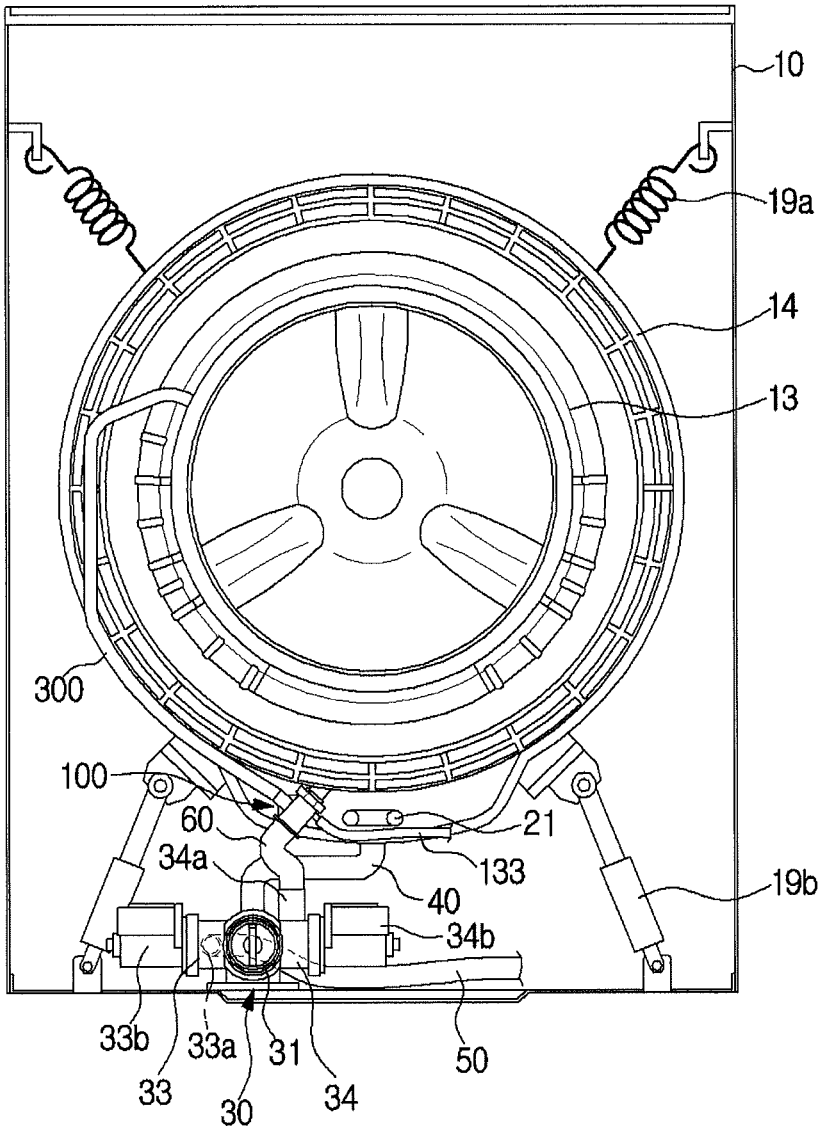
FIG. 3 is a front view illustrating an inner side of the drum washing machine according to one embodiment of the present invention.
Figure 4:
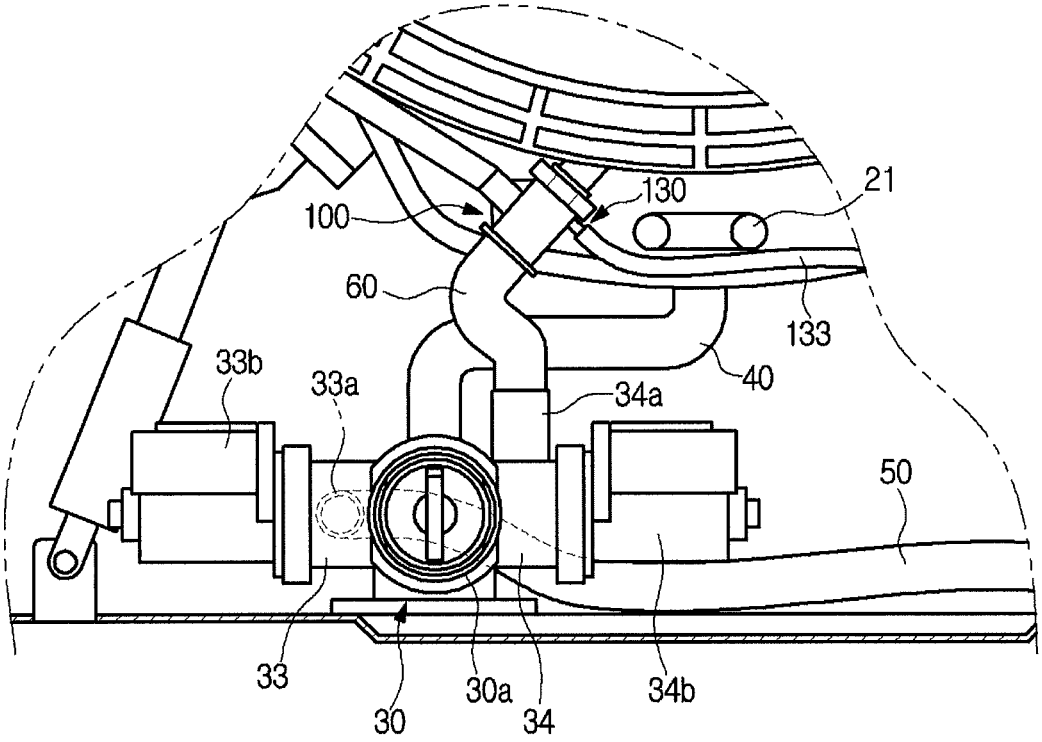
FIG. 4 is a view of a pump and a circulation bubble unit of the drum washing machine according to one embodiment of the present invention.

FIGS. 1 to 3 are views illustrating a drum washing machine having a circulation bubble unit according to one embodiment of the present invention.

As illustrated in FIGS. 1 to 3, the drum washing machine 1 includes a main body 10 which forms an exterior, a tub 14 which is installed in the main body 10 to store wash water when washing is performed, and a drum 13 which is rotatably installed in the tub 14 to have a plurality of dewatering holes 13*a*.

An inlet port 11 is formed at a front surface 10*a* of the main body 10 so that laundry may be put into the drum 13, and a door 12 is also provided to open and close the inlet port 11.

The tub 14 is installed to be suspended in the main body 10 by a spring 19*a* and also to be supported by a damper assembly 19*b*.

A heater 21 which heats the wash water in the tub 14, and a water level sensor 20 which detects a frequency changed according to a water level so as to detect an amount (water level) of wash water in the drum 13 are installed in a lower side of the tub 14.

A water supply unit 15 and a detergent supply unit 16 which supply the wash water and a detergent to the tub 14, respectively, are installed at an inner upper portion of the main body 10.

The water supply unit 15 includes a water supply valve 15*b* connected with an external water suppler (not shown) to control water supply, and a water supply pipe 15*a* configured to connect the water supply valve 15*b* with the detergent supply unit 16.

Water supplied through the water supply unit 15 may pass through the detergent supply unit 16 and then may be supplied into the tub 14 through a guide pipe 17 with the detergent.

A driving unit 18 which rotates the drum 13 is provided at an outer surface of a rear side of the tub 14. The driving unit 18 includes a driving motor 18*a*, a driving shaft 18*b* disposed between the drum 13 and the driving motor 18*a* to transmit a rotating force of the driving motor 18*a* to the drum 13, a bearing housing 18*c* installed at a rear surface plate of the tub 14 to rotatably support the driving shaft 18*b*, and a bearing 18*d* installed between the bearing housing 18*c* and the driving shaft 18*b*.

Meanwhile, a pump 30 which pumps the wash water stored in the tub 14 is installed at an inner lower portion of the main body 10.

Figure 5:
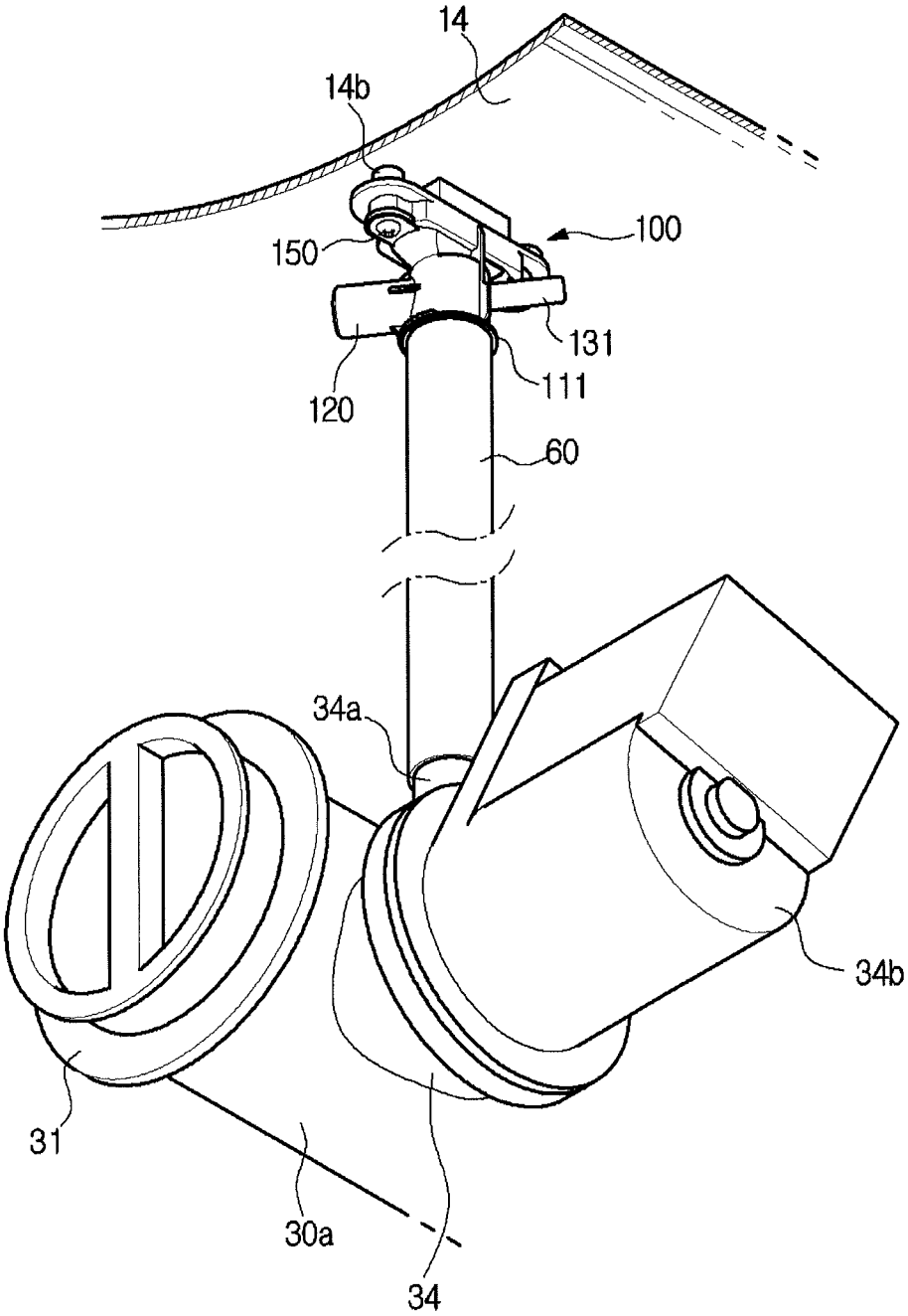
FIG. 5 is a view illustrating the pump and the circulation bubble unit according to one embodiment of the present invention.
Figure 6:
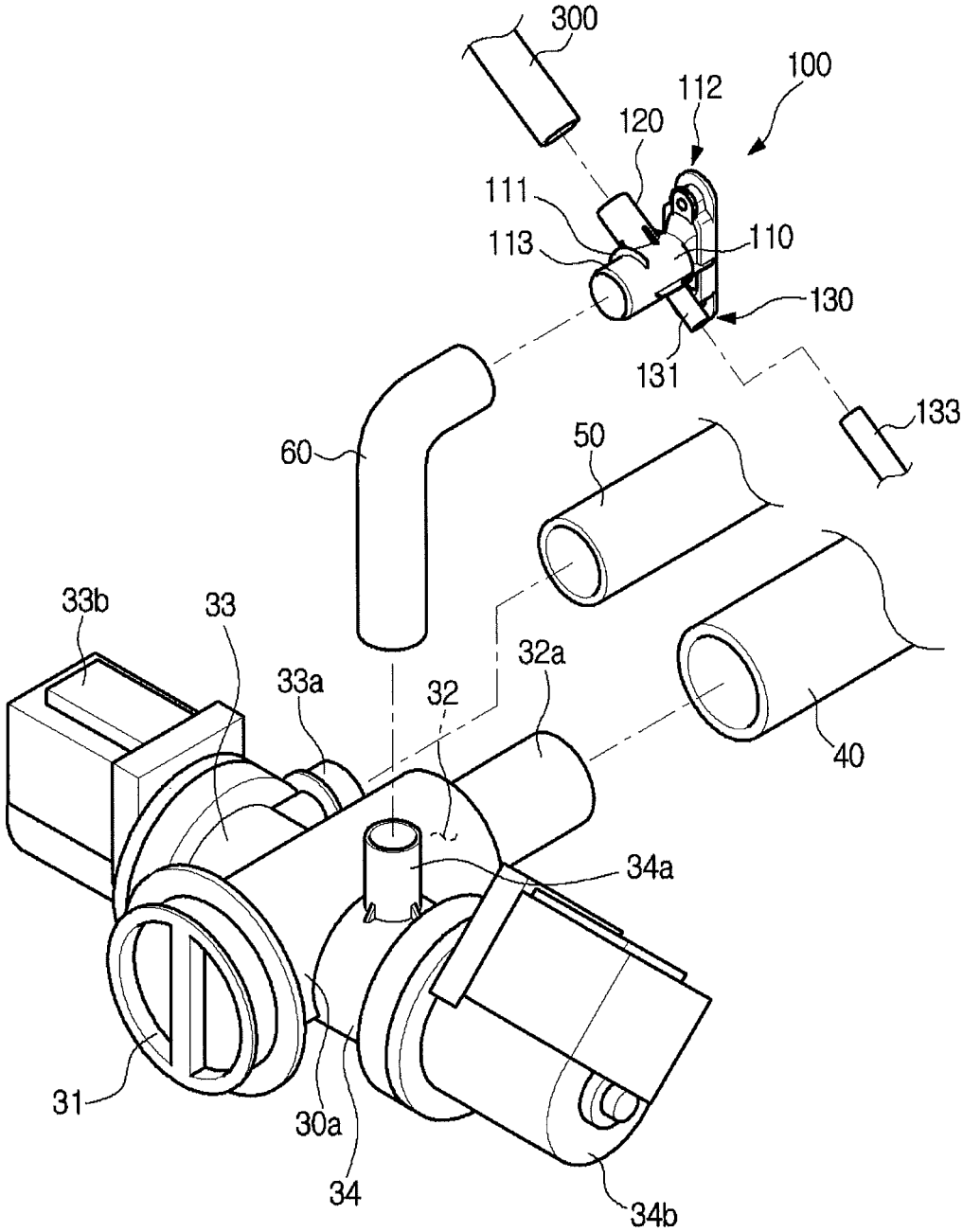
FIG. 6 is an exploded perspective view illustrating the circulation bubble unit connected with the pump according to one embodiment of the present invention.

FIGS. 5 and 6 are views illustrating the pump having a circulation bubble unit according to one embodiment of the present invention.

As illustrated in FIGS. 5 and 6, the pump 30 is connected with a plurality of pipes. The plurality of pipes include a first drainpipe 40 connected to a drain port 14*a* of the tub 14, a second drainpipe 50 which pumps and discharges the wash water to an outside of the main body 10, and a connecting hose 60 connected with the circulation bubble unit 100, which will be described, to circulate the wash water in the pump.

The pump 30 includes a pump case 30*a*, and a filter 31 installed at the pump case 30*a*.

A circulation pump chamber 34, an introduction chamber 32, and a drainage pump chamber 33 are formed at the pump case 30*a*. The circulation pump chamber 34 and the drainage pump chamber 33 are disposed to face each other with the introduction chamber 32 interposed therebetween. The embodiment of the present invention describes an example in which the circulation pump chamber 34 and the drainage pump chamber 33 are disposed at the pump to face each other with the introduction chamber 32 interposed therebetween. However, the spirit of the present invention is not limited thereto. For example, the pump may have various shapes including the circulation pump chamber 34 and the drainage pump chamber 33.

An inlet port 32*a* is formed at the introduction chamber 32 of the pump case 30*a* so as to be in communication with the first drainpipe 40. When the pump 30 operates, the wash water in the tub 14 is introduced into the introduction chamber 32 via the first drainpipe 40 and the inlet port 32*a*.

A filter 31 is installed at the introduction chamber 32 to remove foreign substances contained in the wash water introduced from the tub 14.

An entrance (not shown) opened so that the filter 31 may enter or leave forward and backward is formed at a front portion of the introduction chamber 32, and a screw thread (not shown) is formed around the entrance so that the filter 31 may be screw-coupled thereto.

Meanwhile, impellers (not shown) are installed at the circulation pump chamber 34 and the drainage pump chamber 33 disposed at both sides of the pump case 30*a* to forcibly suck and discharge the wash water in the introduction chamber 32, and the motors 33*b* and 34*b* are connected to the impellers. The impellers suck and discharge the wash water in the introduction chamber 32 while rotating by receiving a driving force from the motors 33*b* and 34*b*.

A drain port 33*a* is formed at the drainage pump chamber 33 to be in communication with the second drainpipe 50 which drains the wash water to the outside of the main body 10.

A circulation port 34*a* is formed at the circulation pump chamber 34 to be connected with the circulation bubble unit 100 which is provided to circulate the wash water and also to generate bubbles.

Therefore, the wash water in the introduction chamber 32 introduced into the circulation pump chamber 34 of the pump 30 is supplied to the circulation bubble unit 100 through the connecting hose 60 connected to the circulation port 34*a*.

Figure 7:
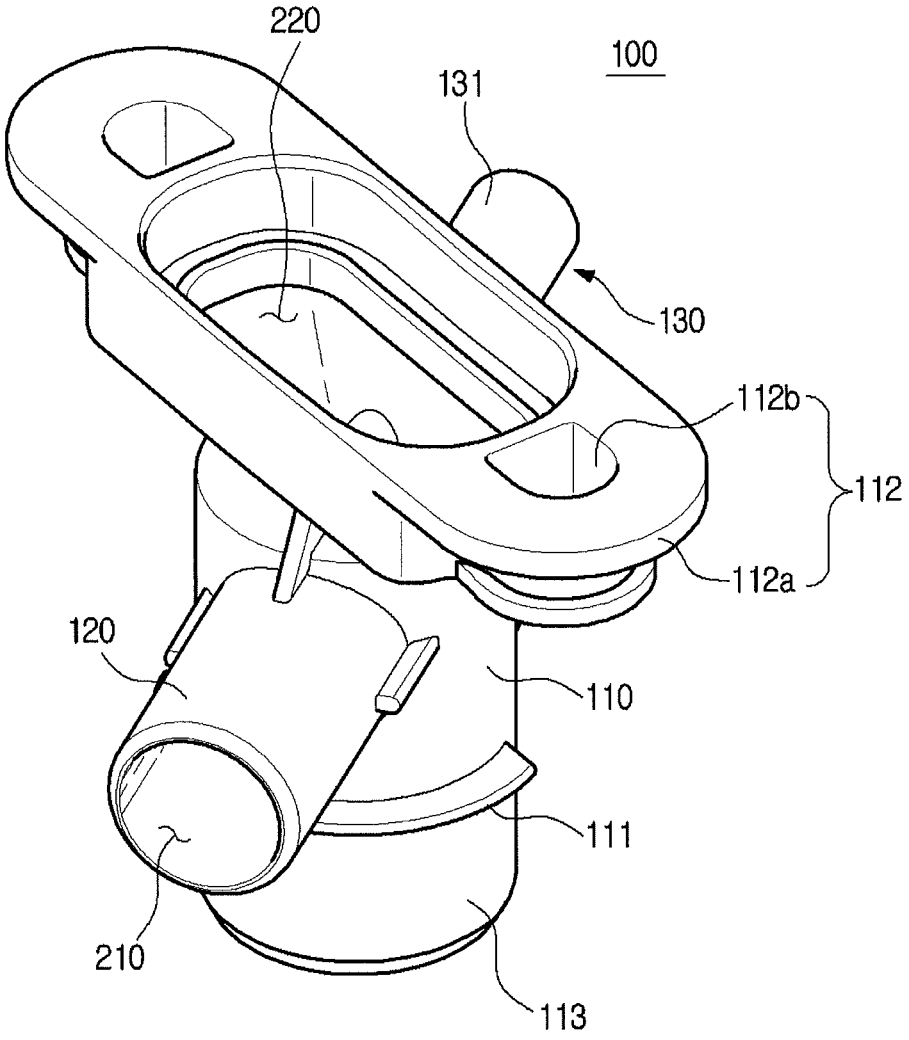
FIG. 7 is a perspective view of the circulation bubble unit according to one embodiment of the present invention.
Figure 8:
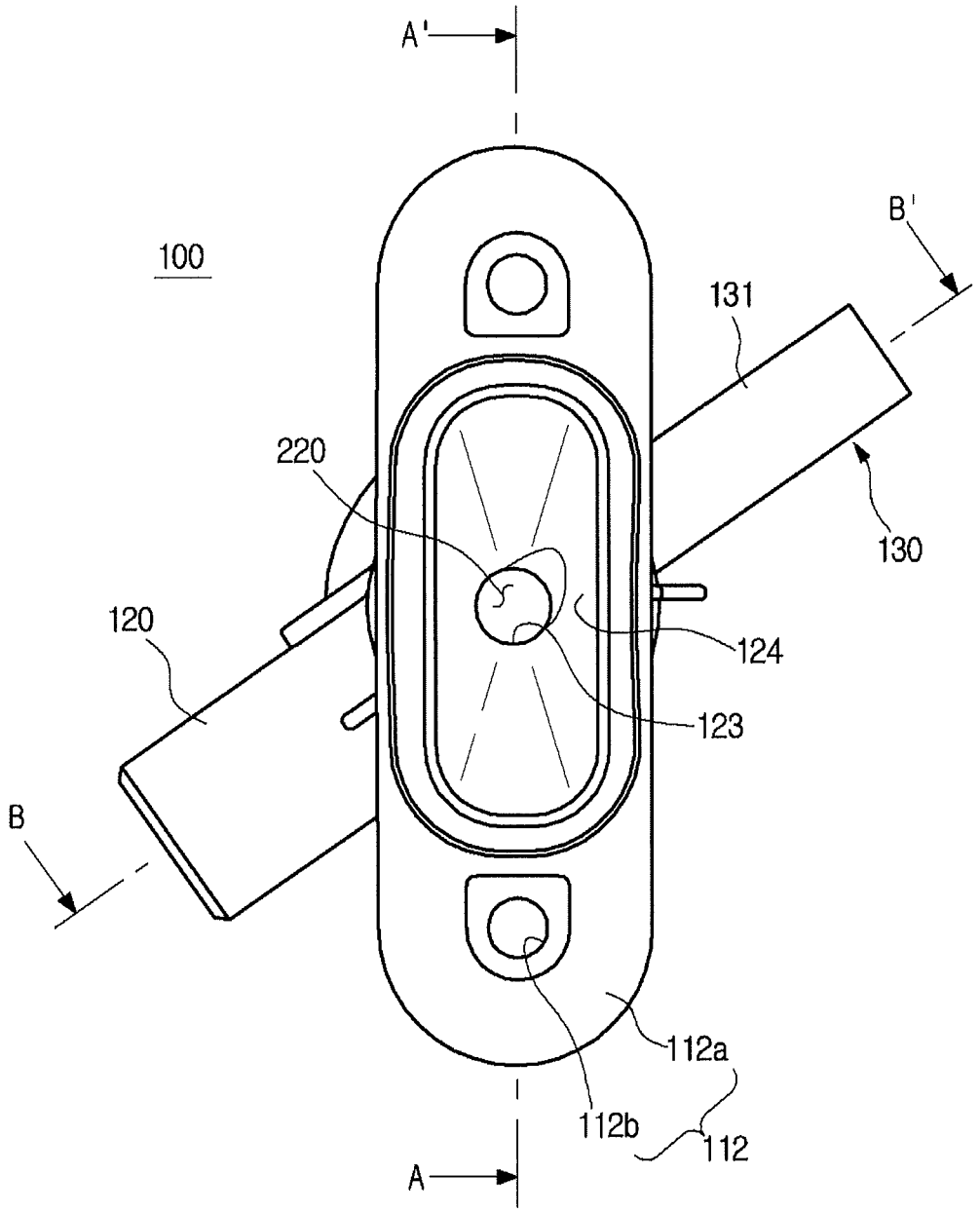
FIG. 8 is a top view of the circulation bubble unit according to one embodiment of the present invention.
Figure 9:
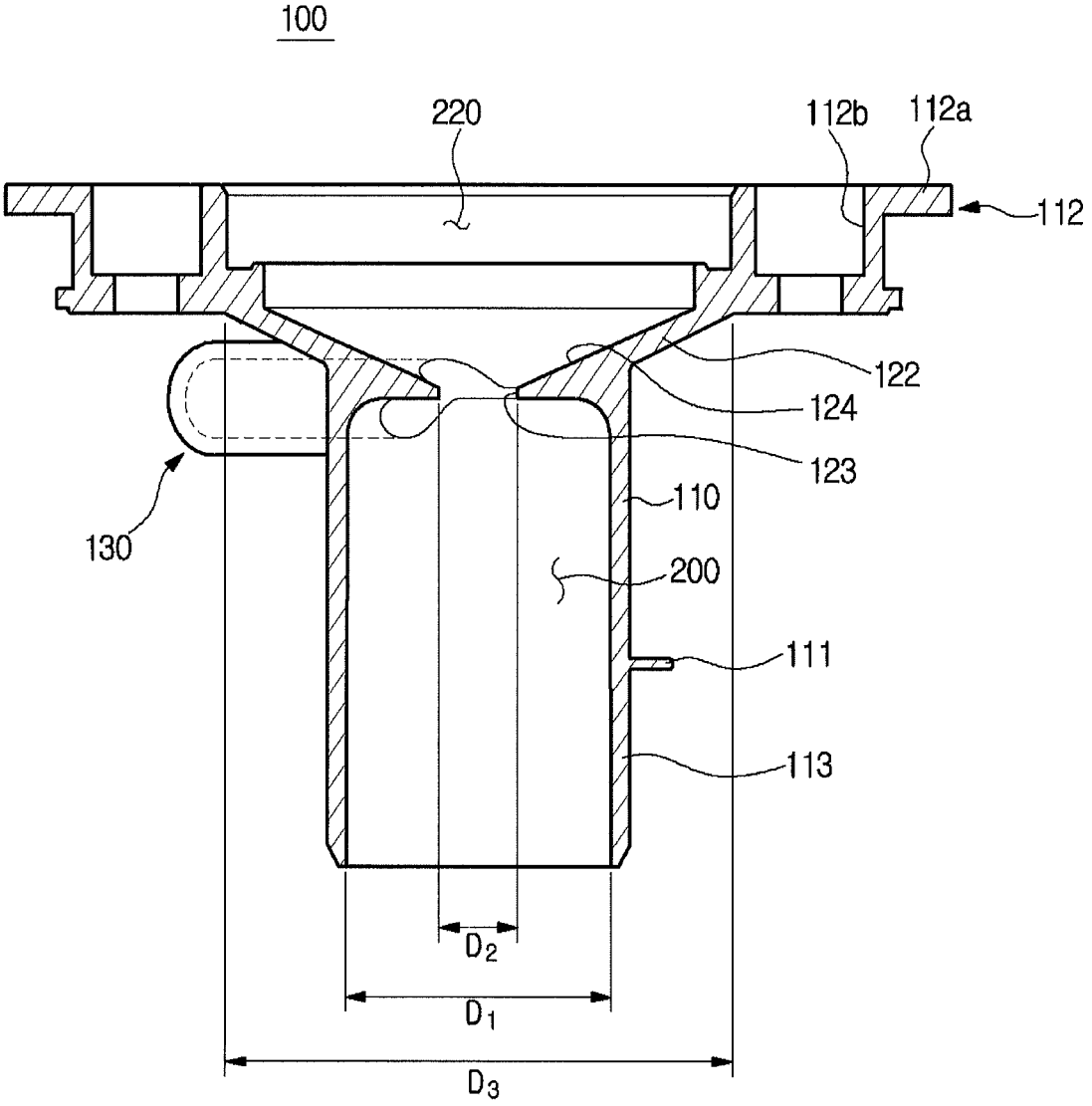
FIG. 9 is a cross-sectional view taken along a line A-A' of FIG. 8.
Figure 10:
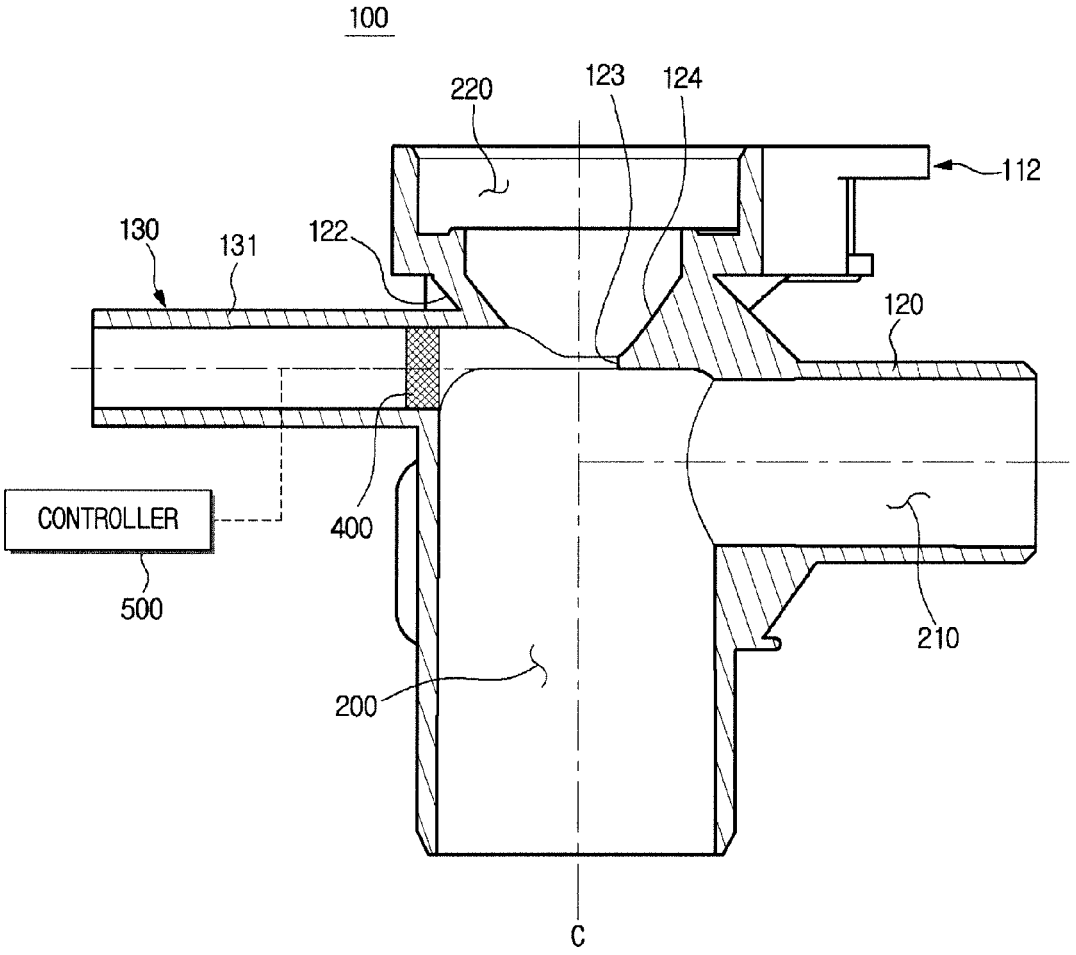
FIG. 10 is a cross-sectional view taken along a line B-B' of FIG. 8.

FIG. 7 is a perspective view of the circulation bubble unit according to one embodiment of the present invention, FIG. 8 is a top view of the circulation bubble unit according to one embodiment of the present invention, FIG. 9 is a cross-sectional view taken along a line A-A' of FIG. 8, and FIG. 10 is a cross-sectional view taken along a line B-B' of FIG. 8.

As illustrated in FIGS. 7 to 10, the circulation bubble unit 100 includes a case 110, a fluid path 200 formed in the case 110, a first fluid path pipe 120 configured to form a first fluid path 210, and a second fluid path pipe 122 configured to form a second fluid path 220.

The case 110 is provided to be installed at an outer surface of the tub 14, and a hollow portion is formed therein to form the fluid path 200 through which the wash water flows. The embodiment describes an example in which the circulation bubble unit 100 is disposed at a left side of a lower surface of the tub 14. However, the spirit of the present invention is not limited thereto. For example, the circulation bubble unit may be disposed at a right side of the lower surface of the tub or at a center of the lower surface thereof.

The case 110 may be formed in a cylindrical shape having a hollow portion therein, and a fixing unit 112 may be provided at an upper end thereof to be fixed to the tub 14.

A connecting hose coupling part 113 to which the connecting hose 60 for connection with the pump 30 is coupled is provided at a lower end of the case 110.

Further, a support rib 111 provided to support the coupling of the connecting hose 60 may be formed on an outer circumferential surface of the case 110. The support rib 111 may be formed at a predetermined position spaced upward from the lower end of the case 110. The support rib 111 is formed on an outer circumferential surface of the case 110 to protrude in a circumferential direction. The support rib 111 may serve as a stopper which restricts an insertion of the connecting hose 60 coupled from the lower end of the case 110.

Meanwhile, the fixing unit 112 of the case 110 is provided at an upper end of the case 110. The fixing unit 112 may be provided to be installed at a tub installation port 14*b* formed at the outer surface of the tub 14.

The fixing unit 112 includes a curved surface corresponding to the outer surface of the tub 14, and also includes an elliptical fixing bracket 112*a* having a hollow portion at a center thereof, and a fixing hole 112*b* formed at both side ends of the fixing bracket 112*a*.

The fixing hole 112*b* may be formed at a position corresponding to the tub installation port 14*b*. The fixing unit 112 may be installed at the tub 14 through a fixing member 150 which passes through the fixing hole 112*b* and the tub installation port 14*b*.

The fixing member 150 may include a bolt, a pin or the like.

The fluid path 200 formed in the case 110 is provided to receive the wash water from the connecting hose 60.

Meanwhile, the case 110 may include the first fluid path 210 provided to circulate some of the wash water supplied through the connecting hose 60 to the tub 14, and the second fluid path 220 provided to generate bubbles in detergent water, in which the wash water and the detergent are mixed, using another some of the wash water.

The first fluid path 210 may be formed to be branched from the fluid path 200. The first fluid path 210 has one end which is in communication with the fluid path 200 of the case 110 and the other end which is provided to be connected to the tub 14.

The first fluid path 210 includes the first fluid path pipe 120 formed to protrude from the one side of the case 110, and a circulation hose 300 provided to connect the first fluid path pipe 120 and the tub 14.

The first fluid path pipe 120 is formed in a cylindrical shape having a hollow portion therein. The circulation hose 300 is coupled to one end of the first fluid path pipe 120. The circulation hose 300 may be formed to be fitted to the first fluid path pipe 120 having the cylindrical shape. The embodiment describes an example in which the circulation hose 300 is fitted to the first fluid path pipe 120. However, the spirit of the present invention is not limited thereto. For example, a protrusion-shaped or groove-shaped coupling portion formed to be coupled with the circulation hose may be formed at the one end of the first fluid path pipe. At this time, the coupling portion may be formed to have a structure which prevents a leakage of the wash water between the circulation hose and the first fluid pipe.

The one end of the first fluid path pipe 120 may be integrally formed at the outer circumferential surface of the case 110. At this time, the first fluid path pipe 120 may be formed in an upper direction of the tub 14 so as to be easily connected with the circulation hose 300.

The circulation hose 300 is provided to connect between the first fluid path pipe 120 and the tub 14. At this time, the circulation hose 300 is provided to be connected to an upper side of the tub 14, such that the wash water is input from an inner upper side of the tub 14 to an inner lower side thereof.

Therefore, the wash water supplied to the tub 14 through the circulation hose 300 may fall from the upper side to the lower side and then may be uniformly distributed up to laundry located at the lower side.

Meanwhile, the second fluid path 220 is integrally formed at an upper side of the case 110 to be in communication with the fluid path 200. The second fluid path 220 includes a reduced diameter portion 123 having a second diameter D2 which is relatively smaller than a first diameter D1 of the fluid path 200, and an increased diameter portion 124 formed to have a relatively greater diameter than the first diameter D1 of the fluid path 200.

The reduced diameter portion 123 is formed to protrude from an inner side of the case 110 toward a center side thereof and thus to form a boundary between the fluid path 200 and the second fluid path 220.

Meanwhile, the second fluid path pipe 122 is formed to be inclined toward a bottom surface of the tub 14, such that the increased diameter portion 124 is formed to have a third diameter D3 which is greater than the second diameter D2 of the reduced diameter portion 123.

At this time, the third diameter D3 may be formed to be any diameter that is greater than the second diameter D2 of the reduced diameter portion 123.

The reduced diameter portion 123 and the increased diameter portion 124 of the second fluid path 220 are formed to reduce flow resistance of the wash water in the fluid path 200 and the second fluid path 220.

Also, an air introducing part 130 which introduces the air to generate the bubbles in the detergent water in which the wash water and the detergent are mixed is provided at the second fluid path 220.

The air introducing part 130 includes an air introduction pipe 131 and an air introduction hose 133 connected to the air introduction pipe 131.

The air introduction pipe 131 may be formed in a cylindrical shape having a hollow portion therein, and may be integrally formed to an outside of the case 110.

The air introduction hose 133 is connected to an end of the air introduction pipe 131, and an end of the air introduction hose 133 is connected with the tub 14 so that air in the tub 14 is introduced into the air introduction pipe 131 through the air introduction hose 133.

Hereinafter, a principle in which the bubble are formed through the air introducing part 130 of the second fluid path 220 of the circulation bubble unit 100 will be described.

When the wash water flowing through the fluid path 200 of the circulation bubble unit 100 is introduced into the second fluid path 220 having a diameter which is smaller than the first diameter D1 of the fluid path 200 of the case 110, a flowing speed of the wash water introduced into the second fluid path 220 becomes faster than when the wash water flows through the fluid path 200. As the flowing speed is increased, a pressure thereof is reduced.

At this time, a pressure difference corresponding to a reduction in the pressure of the second fluid path 220 occurs between the second fluid path 220 and an outside of the air introduction pipe 131 of the air introducing part 130, and air (i.e., air in the tub) outside the air introduction pipe 131 of the air introducing part 130 is introduced into the second fluid path 220 through the air introduction pipe 131 due to the pressure difference and then mixed with the wash water.

This phenomenon is called a venturi effect. The venturi effect is an effect in which, when a fluid passes through a flow path having different diameters or cross-sectional areas, a speed of the fluid is increased in proportion to the square of the diameter, and a pressure thereof is reduced in proportion to the square of the increased speed.

Therefore, the first fluid path 210 and the second fluid path 220 which have different diameters from each other are formed at the fluid path 200 of the case 110 of the circulation bubble unit 100, and the air is supplied into the wash water at the same time when the wash water is circulated through the air introducing part 130, and thus the bubbles are generated.

Meanwhile, an electromagnetic control valve 400 may be installed at the air introducing part 130.

The electromagnetic control valve 400 is provided to control an opening or closing operation through a separate controller 500. When the electromagnetic control valve 400 is used, a bubble function may be performed by supplying the air into the wash water, and also only a circulation function may be performed without the supplying of the air into the wash water.

That is, when the electromagnetic control valve 400 is opened, the air is introduced into the wash water in the second fluid path 220 through the air introducing part 130, and the bubbles are generated. At this time, the second fluid path 220 supplies the bubbles into the tub 14 which is in communication with the second fluid path 220. At the same time, the wash water is circulated and supplied into the tub 14 through the first fluid path 210.

Also, when the electromagnetic control valve 400 is closed, the air introducing part 130 is closed, and thus the air is not introduced into the wash water. Therefore, only the circulation function in which the wash water is circulated and supplied into the tub 14 through the first fluid path 210 is performed.

Figure 11:
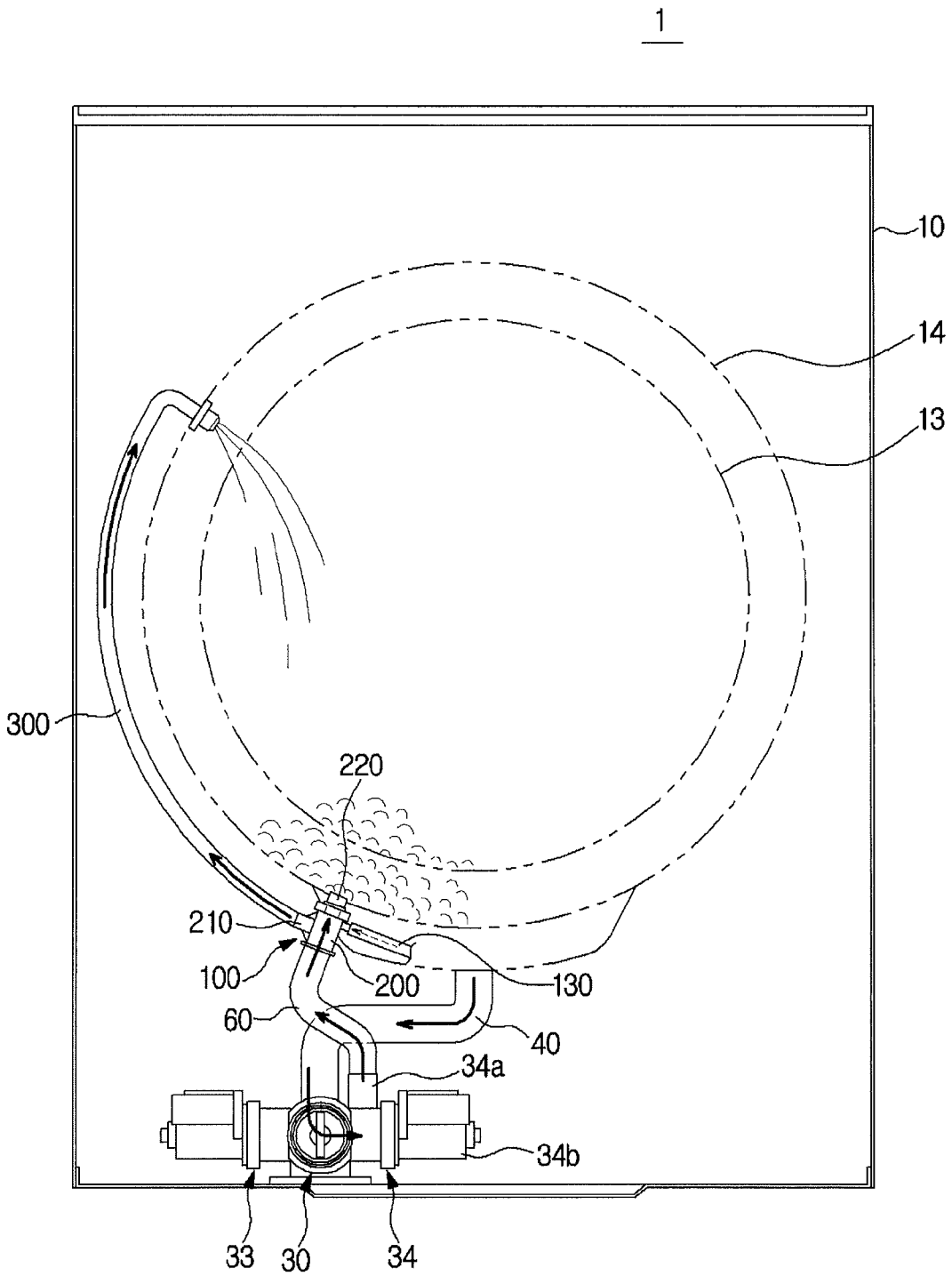
FIG. 11 is a view illustrating an operation of the circulation bubble unit according to one embodiment of the present invention.

As illustrated in FIG. 11, an operation of the circulation bubble unit in a washing process of the laundry will be described.

When the laundry is put into the tub 14 and then the washing machine operates to wash the laundry, the wash water is supplied into the tub 14 through the water supply unit 15.

The wash water supplied into the tub 14 is transferred to the pump 30 through the tub drain port 14*a*.

The wash water introduced into the introduction chamber 32 through the inlet port 32*a* of the pump 30 is transferred to the circulation pump chamber 34 which is in communication with the introduction chamber 32.

The wash water in the circulation pump chamber 34 is transferred to the connecting hose 60 through the circulation port 34*a* and then transferred to the circulation bubble unit 100 connected with the connecting hose 60.

In the wash water introduced into the circulation bubble unit 100, some of the wash water through the first and second fluid paths 210 and 220 of the circulation bubble unit 100 is circulated to an upper portion of the tub 14 through the first fluid path pipe 120 of the first fluid path 210 and the circulation hose 300 connected to the first fluid path pipe 120, and then injected into the tub 14.

Also, in a circulation process of the wash water, the bubbles generated by the venturi effect of the air introduction pipe 131 of the second fluid path 220 and the air introduction hose 133 connected to the air introduction pipe 131 are introduced into the tub 14.

The bubbles supplied into the tub 14 through the second fluid path 220 may remove dirt on the laundry without damage of the laundry.

Meanwhile, by controlling the electromagnetic control valve 400 provided at the air introduction pipe 131, the bubble function and the circulation function of the wash water may be selectively used. Thus, the bubble function and the circulation function of the wash water may be used at the same time, or only the circulation function of the wash water may be used without the bubble function, and this it is possible to enhance user's convenience.

Further, when the wash water is supplied to have a predetermined water level or less, the controller 500 may detect this state through the water level sensor 20 and thus may control the circulation bubble unit 100 not to operate. Therefore, it is possible to enhance user's safety.

Figure 12:
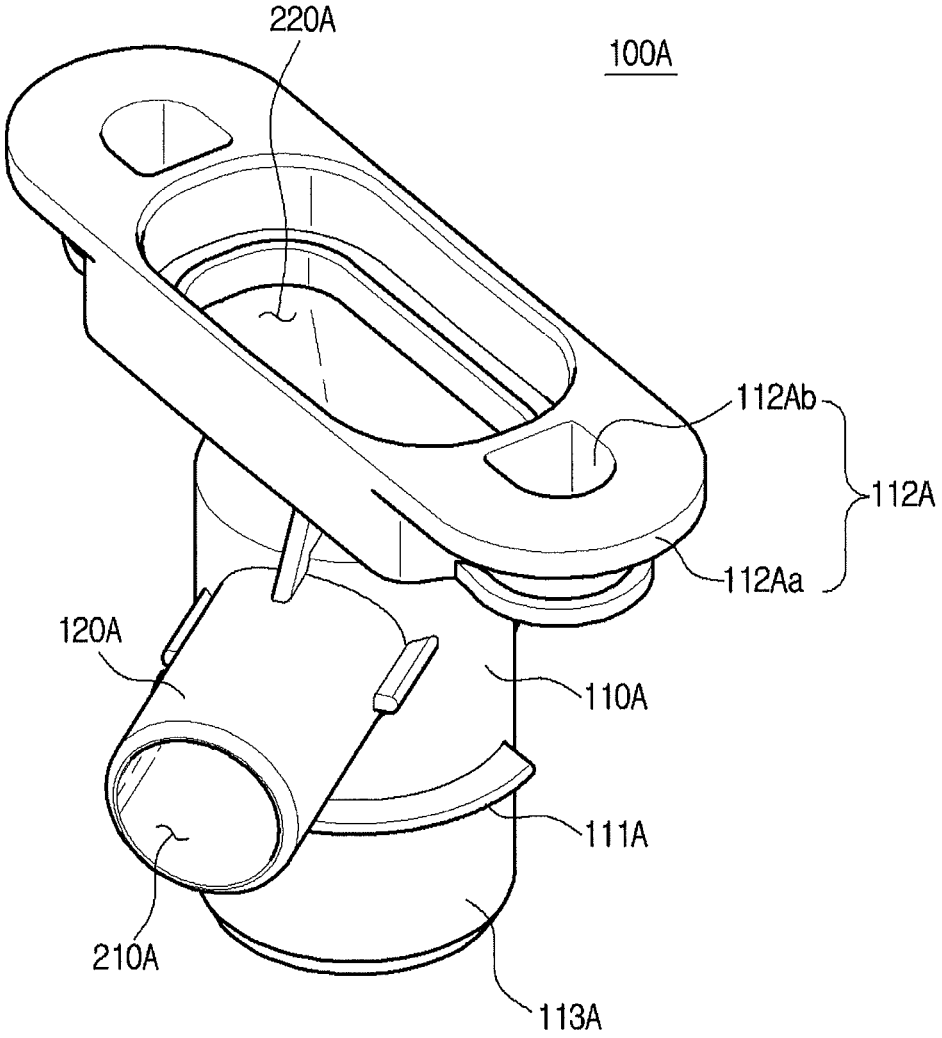
FIG. 12 is a perspective view illustrating a circulation bubble unit according to another embodiment of the present invention.
Figure 13:
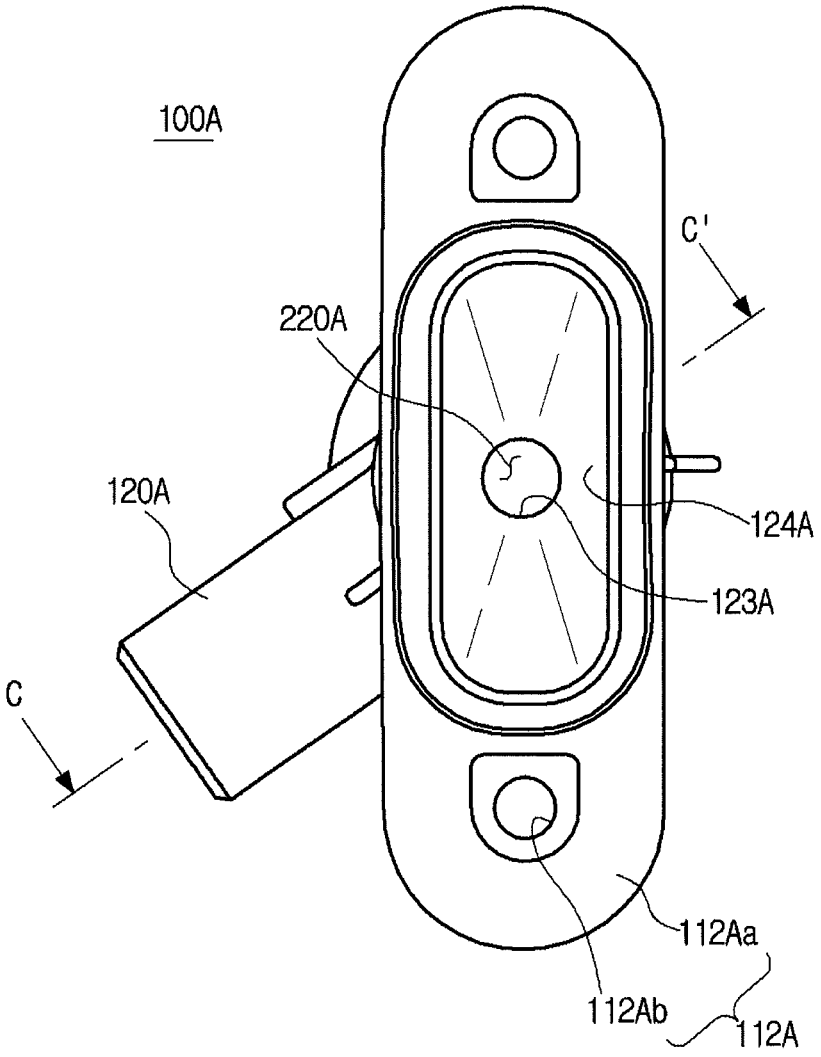
FIG. 13 is a top view of the circulation bubble unit according to another embodiment of the present invention.
Figure 14:
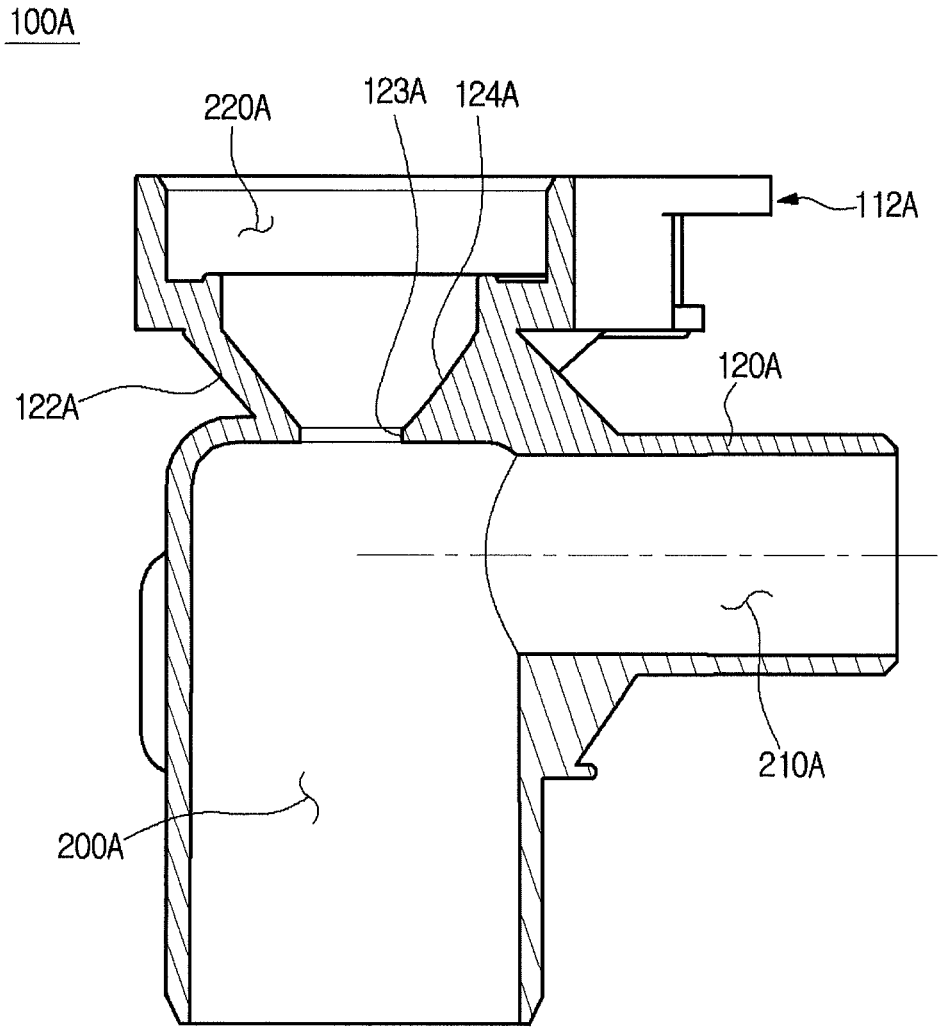
FIG. 14 is a cross-sectional view taken along a line C-C' of FIG. 13.
Figure 15:
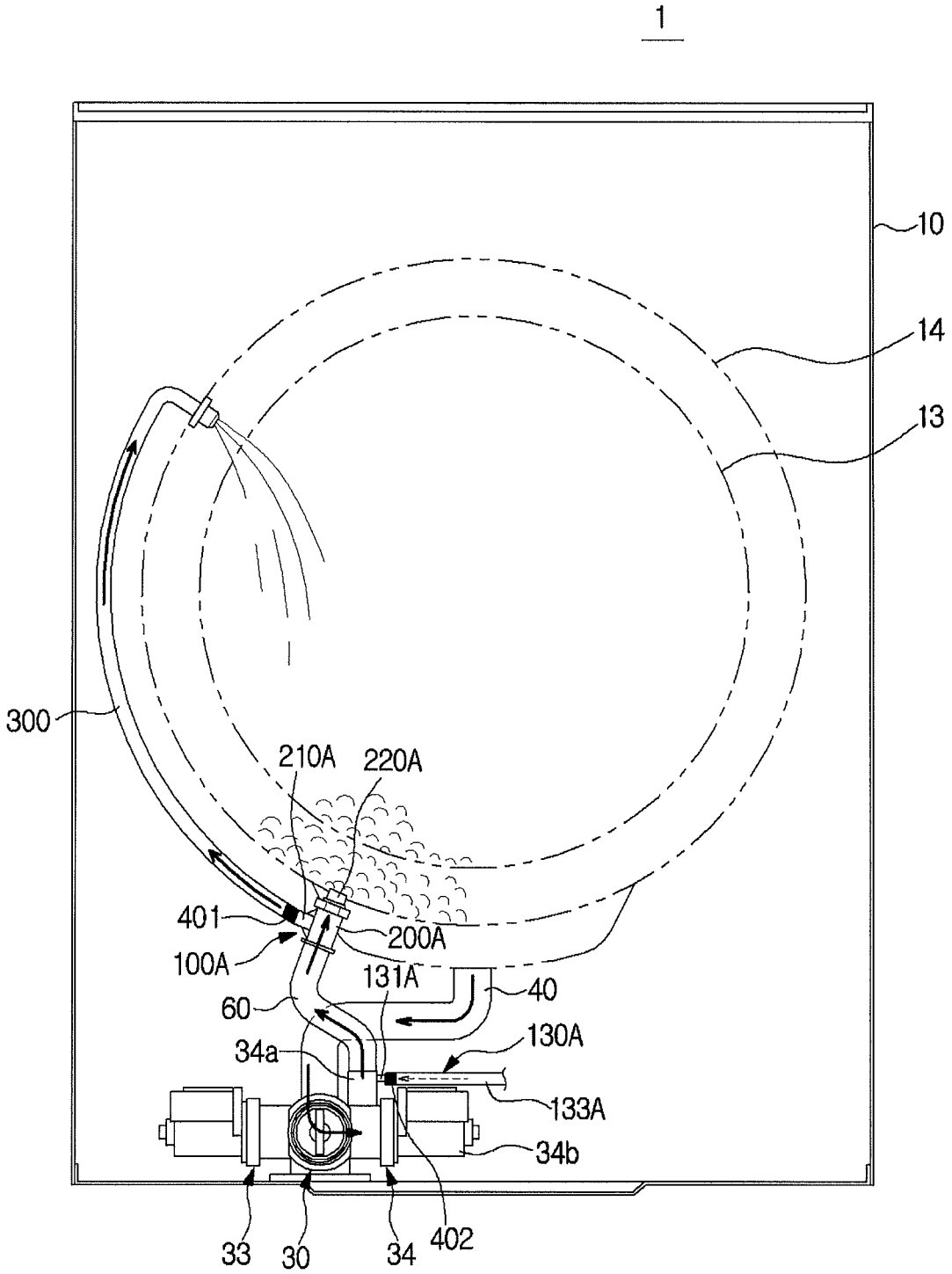
FIG. 15 is a view illustrating an operation of the circulation bubble unit according to another embodiment of the present invention.

FIG. 12 is a perspective view illustrating a circulation bubble unit according to another embodiment of the present invention, FIG. 13 is a top view of the circulation bubble unit according to another embodiment of the present invention, FIG. 14 is a cross-sectional view taken along a line C-C' of FIG. 13, and FIG. 15 is a view illustrating an operation of the circulation bubble unit according to another embodiment of the present invention.

As illustrated in FIGS. 12 to 15, the circulation bubble unit 100A according to another embodiment of the present invention includes a case 110A, a fluid path 200A formed in the case 110A, a first fluid path pipe 120A configured to form a first fluid path 210A, and a second connecting pipe 122A configured to form a second fluid path 220A.

The case 110A is provided to be installed at the outer surface of the tub 14, and has a hollow portion therein to form the fluid path 200A through which the wash water flows. The case 110A may be formed in a cylindrical shape having a hollow portion therein, and a fixing unit 112A may be provided at an upper end thereof to be fixed to the tub 14.

A connecting hose coupling part 113A to which the connecting hose 60 for connection with the pump 30 is coupled is provided at a lower end of the case 110A.

Further, a support rib 111A provided to support the coupling of the connecting hose 60 may be formed on an outer circumferential surface of the case 110A. The support rib 111A may be formed at a predetermined position spaced upward from the lower end of the case 110A. The support rib 111A is formed on an outer circumferential surface of the case 110A to protrude in a circumferential direction. The support rib 111A may serve as a stopper which restricts an insertion of the connecting hose 60 coupled from the lower end of the case 110A.

The fixing unit 112A of the case 110A is provided at an upper end of the case 110A. The fixing unit 112A may be provided to be installed at a tub installation port 14*b* formed at the outer surface of the tub 14.

The fixing unit 112A includes a curved surface corresponding to the outer surface of the tub 14, and also includes an elliptical fixing bracket 112Aa having a hollow portion at a center thereof, and a fixing hole 112Ab formed at both side ends of the fixing bracket 112Aa.

The fluid path 200A formed in the case 110A is provided to receive the wash water from the connecting hose 60.

Meanwhile, the case 110A may include the first fluid path 210A provided to circulate some of the wash water supplied through the connecting hose 60 to the tub 14, and the second fluid path 220A provided to generate bubbles in detergent water, in which the wash water and the detergent are mixed, using another some of the wash water.

The first fluid path 210A may be formed to be branched from the fluid path 200A. The first fluid path 210A has one end which is in communication with the fluid path 200A of the case 110A and the other end which is provided to be connected to the tub 14.

The first fluid path 210A includes a first fluid path pipe 120A formed to protrude from one side of the case 110A, and a circulation hose 300 provided to connect the first fluid path pipe 120A and the tub 14.

The first fluid path pipe 120A is formed in a cylindrical shape having a hollow portion therein. The circulation hose 300 is coupled to one end of the first fluid path pipe 120A. The circulation hose 300 may be formed to be fitted to the first fluid path pipe 120A having the cylindrical shape. The embodiment describes an example in which the circulation hose 300 is fitted to the first fluid path pipe 120A. However, the spirit of the present invention is not limited thereto. For example, a protrusion-shaped or groove-shaped coupling portion formed to be coupled with the circulation hose may be formed at the one end of the first fluid path pipe. At this time, the coupling portion may be formed to have a structure which prevents a leakage of the wash water between the circulation hose and the first fluid pipe.

One end of a first fluid path pipe 120A is integrally formed at the outer surface of the case 110A.

At this time, the first fluid path pipe 120A may be formed in an upper direction of the tub 14 so as to be easily connected with the circulation hose 300.

The circulation hose 300 is provided to connect the first fluid path pipe 120A and the tub 14. At this time, the circulation hose 300 is provided to be connected to an upper side of the tub 14, such that the wash water is supplied from an inner upper side of the tub 14 to an inner lower side thereof.

Therefore, the wash water supplied to the tub 14 through the circulation hose 300 may fall from the upper side to the lower side and then may be uniformly distributed up to laundry located at the lower side.

Meanwhile, the second fluid path 220A is integrally formed at an upper side of the case 110A to be in communication with the fluid path 200A. The second fluid path 220A includes a reduced diameter portion 123A having a second diameter D2 which is relatively smaller than a first diameter D1 of the fluid path 200A, and an increased diameter portion 124A formed to have a relatively greater diameter than the first diameter D1 of the fluid path 200A.

The reduced diameter portion 123A is formed to protrude from an inner side of the case 110A toward a center side thereof so as to form a boundary between the fluid path 200A and the second fluid path 220A.

The reduced diameter portion 123A and the increased diameter portion 124A of the second fluid path 220A are formed to reduce flow resistance of the wash water in the fluid path 200A and the second fluid path 220A.

Meanwhile, the bubble circulation unit 100A further includes an air introducing part 130A provided to introduce air into the detergent water in which the wash water and the detergent are mixed.

The air introducing part 130A includes an air introduction pipe 131A and an air introduction hose 133A connected to the air introduction pipe 131A.

The air introduction pipe 131A may be formed in a cylindrical shape having a hollow portion therein, and the air introduction hose 133A is connected to an end thereof.

Although not illustrated, the air introduction hose 133A may be connected to the upper side of the tub 14.

The air introduction pipe 131A may be installed at the circulation pump chamber 34 of the pump 30.

The air introduction pipe 131A may be formed to be in communication with a circulation port 34*a* formed at the circulation pump chamber 34.

The air introduced into the circulation pump chamber 34 through the air introduction pipe 131A is mixed with the wash water and then introduced into the fluid path 200A of the circulation bubble unit 100A through a connecting hose 60.

At this time, electromagnetic control valves 401 and 402 which control an opening and closing operation may be installed at the air introducing part 130A and the first fluid path pipe 120A, respectively.

Each of the electromagnetic control valves 401 and 402 may be provided to control the opening or closing operation through a separate controller 500.

When only the circulation function of the wash water is used, the electromagnetic control valve 402 of the air introducing part 130A is closed to block introduction of the air.

Also, when only the bubble function is used, the first fluid path 210A is closed and the bubbles are introduced into the tub 14 through the second fluid path 220A.

When the circulation function and the bubble function are used at the same time, each of the electromagnetic control valves 401 and 402 is opened, and the air is introduced through the air introducing part 130A, and the bubbles are generated.

Therefore, the wash water may be circulated and supplied into the tub 14 through the first fluid path 210, and the bubbles may be supplied into the tub 14 through the second fluid path 220.

According to one embodiment of the present invention, since the circulation function and the bubble function can be realized at the same time, the detergent water can be more effectively transferred to the laundry using the bubble and the circulation function.

Also, according to the present invention, the wash water can be uniformly infiltrated into the entire laundry by the circulation function, and also the washing performance can be enhanced without the damage of surfaces and fibers of the laundry through the bubble function.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a main body;

a tub provided in the main body;

a pump provided to circulate wash water into the tub; and a circulation bubble unit provided on a flowing route of the wash water flowing out from the pump to the tub, wherein the circulation bubble unit comprises a case to form an exterior and having a fluid path formed therein to receive the wash water from the pump;

a first fluid path pipe formed to be branched from the fluid path of the case;

a second fluid path pipe provided to be in communication with the fluid path and the tub;

an air introducing part to introduce air into the second fluid path pipe to generate wash water having bubbles; and an electromagnetic control valve to open and close the air introducing part, wherein when the electromagnetic control valve is closed only wash water without bubbles is supplied to the tub via both the first fluid path pipe and second fluid path pipe to perform only a circulation function, and wherein when the electromagnetic control valve is open wash water without bubbles is supplied to the tub via the first fluid path pipe and wash water with bubbles is supplied to the tub via the second fluid path pipe to perform both of the circulation function and a bubble function simultaneously.

2. The washing machine according to claim 1, wherein the circulation bubble unit further comprises a fixing unit is provided at the case to be fixed with the tub.

3. The washing machine according to claim 2, wherein the fluid path, the first fluid path pipe and the second fluid path pipe are formed to have different diameters from each other.

4. The washing machine according to claim 2, further comprising a circulation hose configured to connect the first fluid path pipe with the tub.

5. The washing machine according to claim 2, wherein the second fluid path pipe is formed to be inclined upward toward a bottom surface of the tub.

6. The washing machine according to claim 5, wherein the second fluid path pipe comprises a reduced diameter portion formed to have a diameter which is smaller than that of the first fluid path pipe, and an increased diameter portion formed to be inclined toward the bottom surface of the tub so as to have a greater diameter than the reduced diameter portion.

7. The washing machine according to claim 2, wherein the fixing unit is provided to protrude from an outer circumferential surface of one end of the case and to be coupled to the bottom surface of the tub.

8. The washing machine according to claim 2, further comprising a connecting hose provided to connect the case and the pump.

9. The washing machine according to claim 2, wherein the air introducing part is disposed at an outer circumferential surface of the case to be in communication with the second fluid path pipe.

10. The washing machine according to claim 9, wherein the air introducing part is provided to connect the case and the tub.

11. The washing machine according to claim 1, wherein the pump comprises an introduction chamber into which the wash water in the tub is introduced, a circulation pump chamber provided to supply the wash water into the tub, and a drainage pump chamber provided to discharge the wash water to an outside of the main body, and the circulation bubble unit is connected to the circulation pump chamber.

12. The washing machine according to claim 11, wherein the air introducing part is disposed at the circulation pump chamber.

* * * * *